United States Patent [19]

Sulosky et al.

[11] Patent Number: 4,693,518

[45] Date of Patent: Sep. 15, 1987

[54] MEANS FOR HOLDING CUTTER BITS

[75] Inventors: William P. Sulosky, Winber; Raymond D. Evans, Jr., Everett, both of Pa.

[73] Assignee: Kennametal, Inc., Latrobe, Pa.

[21] Appl. No.: 931,922

[22] Filed: Nov. 14, 1986

Related U.S. Application Data

[63] Continuation of Ser. No. 223,257, Jan. 8, 1981, abandoned, which is a continuation-in-part of Ser. No. 141,775, Apr. 21, 1980, abandoned.

[51] Int. Cl.[4] ..... F21C 25/12; F21C 35/18

[52] U.S. Cl. ..... 299/93; 299/86

[58] Field of Search ..... 299/93, 86

[56] References Cited

U.S. PATENT DOCUMENTS

| | | | |
|---|---|---|---|
| 532,510 | 11/1895 | Wiggs, Jr. | 299/83 |
| 2,950,096 | 8/1960 | Krekeler et al. | 262/33 |
| 3,093,365 | 6/1963 | Krekeler | 299/92 |
| 3,101,933 | 8/1963 | Krekeler | 262/33 |
| 3,397,012 | 8/1968 | Krekeler | 299/86 |
| 3,397,013 | 8/1968 | Krekeler | 299/86 |
| 3,463,521 | 8/1969 | Helton | 287/100 |
| 3,498,677 | 3/1970 | Morrow | 299/86 |
| 3,749,449 | 7/1973 | Krekeler | 299/93 |
| 3,841,708 | 10/1974 | Kniff | 299/86 |
| 4,057,294 | 11/1977 | Krekeler | 299/93 |
| 4,163,581 | 8/1979 | Krekeler | 299/91 |
| 4,180,292 | 12/1979 | Persson | 299/92 |
| 4,240,669 | 12/1980 | Rollins | 299/86 |
| 4,275,929 | 6/1981 | Krekeler | 299/86 |
| 4,302,055 | 11/1981 | Persson | 299/93 |

OTHER PUBLICATIONS

Joy Mfg. Co., "Tritite" Bit, advertisement and drawings, 1978.

Kennametal, Inc., Block and Sleeve Catolog, 1978, pp. 1–16.

*Primary Examiner*—James A. Leppink

*Assistant Examiner*—David J. Bagnell

*Attorney, Agent, or Firm*—John J. Prizzi

[57] ABSTRACT

Devices for holding mining and road maintenance cutter bits, wherein said devices for holding comprise a cutter bit support block, a clevis and a support block locking mechanism whose geometries have been adapted such that the cutter bit support block can be fixedly and rigidly held in a channel in the clevis by the support block locking mechanism, which has a locking bolt. The support block locking mechanism and the clevis have means for interacting and cooperating such that each abuts with, and applies a downward pressure to, a lower body portion of the support block and thereby drives downward facing longitudinal shoulders on the support block into abutment under pressure with upward facing abutment shoulders of two longitudinal walls forming the channel in the clevis.

48 Claims, 13 Drawing Figures

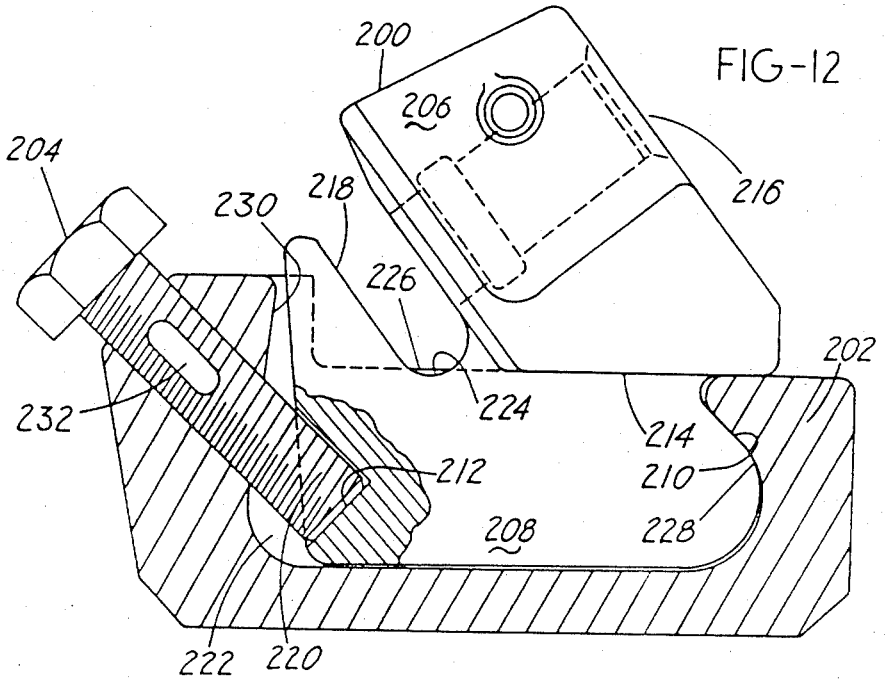
FIG-12
FIG-13
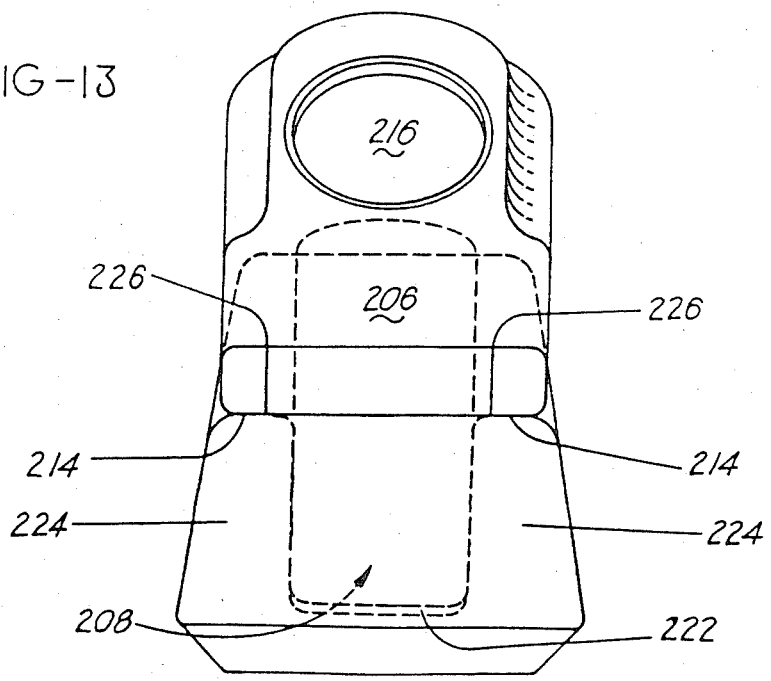

MEANS FOR HOLDING CUTTER BITS

RELATED APPLICATION

This application is a continuation of U.S. application Ser. No. 06/223,257, filed Jan. 8, 1981, and now abandoned, which in turn, is a contiuation-in-part of U.S. application Ser. No. 06/141,775, filed Apr. 21, 1980, and now abandoned.

BACKGROUND OF THE INVENTION

This invention relates to devices for holding cutter bits used in road maintenance and, especially, in the mining of coal and other minerals. More particularly, it relates to those holding devices known as cutter bit support blocks, or bit holders, and mounting bases, or clevi, used to releasably hold said support blocks, and especially those arrangements where the support block is firmly fixed in the clevis by a locking mechanism attached to the clevis which abuts against the support block.

Recently, the coal mining industry has shown renewed interest in coal mining cutter bit holder systems which do not allow the bit support block to move in relation to the clevis in which it is located during mining operations. Movement of the support block within and against the clevis causes premature wearing of the support block and clevis, thereby reducing cutting efficiency and reducing the effective lifetime of the cutting drum or chain on which these bit holders are mounted.

In addition, when the clevis and support block are worn, the movement of the support block against the clevis produces a loud rattling noise in the mine during machine operation. Such noise produces, at the least, an uncomfortable working condition for the miners and, thereby, is a hinderance to achieving optimum productivity.

The above-mentioned bit holder systems firmly holding a bit support block in a clevis require the use of a locking mechanism as an integral part of a clevis. Examples of such arrangements are illustrated in U.S. Pat. Nos. 3,749,449; 3,397,013; 3,397,012; and 3,093,365. However, these arrangements share the common drawback that the locking mechanism, a threaded bolt, is held in a threaded perforation which is through the clevis itself. Having the locking bolt held in this manner is a drawback because, should the bolt break in the perforation, the threads on the perforation be stripped or corroded to the point where they can no longer tightly hold a bolt, the whole clevis is rendered useless and should be replaced.

Replacement of a clevis, if it is welded to a chain or drum, requires cutting it off with a torch or arc and welding on a new one in its place, if possible. If the clevis is itself a link in a continuous chain, the chain must be opened up to replace the clevis. Both manners of replacement are expensive due to the downtime, labor and replacement part cost required to affect a repair.

It should additionally be noted that in the prior art bit holding arrangements shown in U.S. Pat. Nos. 3,397,013; 3,397,012; and 3,093,365, the bolt was typically held horizontally or at a small rearward and downward incline in a threaded perforation in the clevis and abutted against a substantially vertical forward wall on the support block shank located in a uniform cross section vertical perforation in the clevis. This abutment between the bolt and the forward face of the support block forced a rear vertical wall of the support block into abutment with a rear vertical wall of the vertical perforation in the clevis. Where the forward wall of the support block was vertical, there was typically a shallow recess located in this wall into which the locking bolt entered.

These prior art bit holding arrangements did little or nothing to draw downward facing longitudinal shoulders of the support block into abutment with upward facing abutment shoulders on the clevis. Therefore, locking the support block into the clevis did not produce, or produced very little, upward preload on the support block shoulders to resist downward cutting forces produced during operation.

The bit holding arrangement shown in U.S. Pat. No. 3,749,449, FIG. 16, in addition to suffering from the disadvantage of having the locking mechanism as an integral part of the base member, relies upon abutment between the bottom surface of support block and the top sloping surface of the clevis to resist out of plane cutting forces, rather than abutment between shoulders on the support block and the clevis on both sides of the support block.

BRIEF SUMMARY OF THE INVENTION

Applicants have invented devices for holding mining and road maintenance cutter bits, wherein said devices for holding comprise a cutter bit support block, a clevis and a support block locking mechanism. The cutter support block has two major portions; a lower body, or shank, and an upper body portion.

The lower body portion has a forward face slanting rearwardly upward and a rear face slanting forwardly upward. The upper body portion has downward facing longitudinal shoulders ending at the juncture of the upper and lower body portions. The support block also has a perforation for receiving the shank of a cutter bit.

The support block is held in a channel in a clevis by a support block locking mechanism. The support block locking mechanism is slidably engaged in recesses or grooves for holding said mechanism near the forward end of said clevis which is also in front of the forward face of the lower body portion of the support block. This support block locking mechanism has a threaded perforation which holds a threaded bolt which acts as means for releasable abutment with the support block and releasable locking of wings on the locking mechanism which are engaged in said recesses or grooves in said clevis. When the bolt is abutted against the support block, it applies a rearward and downward pressure to the forward face of said support block, which simultaneously apply, through the wings engaged in the clevis recesses, a forward and upward pressure against the clevis which releasably fixes the locking mechanism in relation to the clevis and the support block held in the clevis.

The rearward component of the rearward and downward pressure applied by the locking mechanism to the support block causes the rear face of the support block to abut with a rear forwardly and upwardly similar sloping block abutment wall forming the rear wall of a channel in the clevis located between two longitudinal walls. These walls have upward facing abutment shoulders which rigidly abut and support the downward facing longitudinal abutment shoulders on said support block due to the rearward and downward pressure applied by the locking mechanism to the support block which also, in turn, produces additional downward pressure on the support block due to the rear sloping block abutment wall in the clevis channel abutting with the rear face of the lower body portion of the support block.

These new cutter bit holding devices and their arrangement can be quickly and cheaply repaired in comparison with the prior art in the repair situations mentioned in the background. This is due to the fact that applicants' arrangement places the bolt perforation through a replaceable locking mechanism slidably engaged and releasably lockable in the forward end of a clevis. Therefore, should a bolt break in the threaded perforation or the threads on the perforation be stripped, only the locking mechanism, which is easily replaceable, need be changed and not the entire clevis. This can be done by the mining machine operator without cutting and welding.

In addition, the geometry and arrangement of the cutter bit holding devices disclosed herein allow a significant downward pressure, or preload, to be applied to the support block when it is locked in place on clevis. Therefore, during lockup of the support block, its downward facing abutment shoulders are driven into pressurized abutment with the upward facing abutment shoulders on the support block. In this manner, the present arrangement overcomes the failure of the prior art devices to produce a significant preload in this direction and, therefore, it should be better able to resist downward movement of the support block under the forces encountered during cutting.

In an alternate embodiment of the above invention, which also operates as described above to provide a significant preload between the support block and clevis, the locking mechanism at the front of the clevis has been replaced by a locking bolt at the rear of the clevis. By moving the bolt to the rear of the clevis, the bolt may now be at least partially shielded from damage by the upper portion of the support block.

In connection with the above devices, it should be noted that the support block and clevis can be fitted with or formed so as to provide any of the cutter bit seating shoulders, abutment surfaces, sleeves, retaining clips and other devices, within the skill of those of ordinary skill in the art, for retaining and supporting either rotatable or nonrotatable cutter bit shanks in the support block perforation.

It should further be noted that the clevis can be either bolted, pinned, or welded to a rotary drum or continuous chain.

It is, therefore, the object of this invention to provide a support block locking mechanism which is easily detached from a clevis and replaced.

It is a further object of this invention to provide a support block which has a shank or lower body portion with a forward face slanting rearwardly upward and a rear face slanting forwardly upward.

Another object of this invention is to provide a clevis having a channel for receiving the shank of a support block, and having means at its forward end for receiving a support block locking mechanism and a rear forwardly and upwardly sloping channel wall for abutment against a similarly sloping support block face.

It is also an object of the present invention to provide a clevis having a locking bolt at the rear of its channel for applying a downward and forward pressure to a support block in the channel.

It is also an object of this invention to provide an arrangement where a cutter bit support block is fixedly and rigidly held in a channel of a clevis by a support block locking mechanism having a means for locking; and the support block locking mechanism and the clevis having means for interacting and cooperating such that each abuts with and applies a downward pressure to the lower body portion of a support block thereby driving downward facing longitudinal shoulders of said support block into abutment under pressure with upward facing abutment shoulders of two longitudinal walls forming the channel of the clevis.

BRIEF DESCRIPTION OF THE DRAWINGS

The exact nature of the present invention will become more clearly apparent upon reference to the following detailed specification taken in connection with the accompanying drawings in which:

FIG. 12 is a side sectionalized view of an alternate embodiment of the invention as shown in FIGS. 1 through 11.

FIG. 13 is a front view of the embodiment shown in FIG. 12.

DETAILED DESCRIPTION OF THE INVENTION

Figure 1:
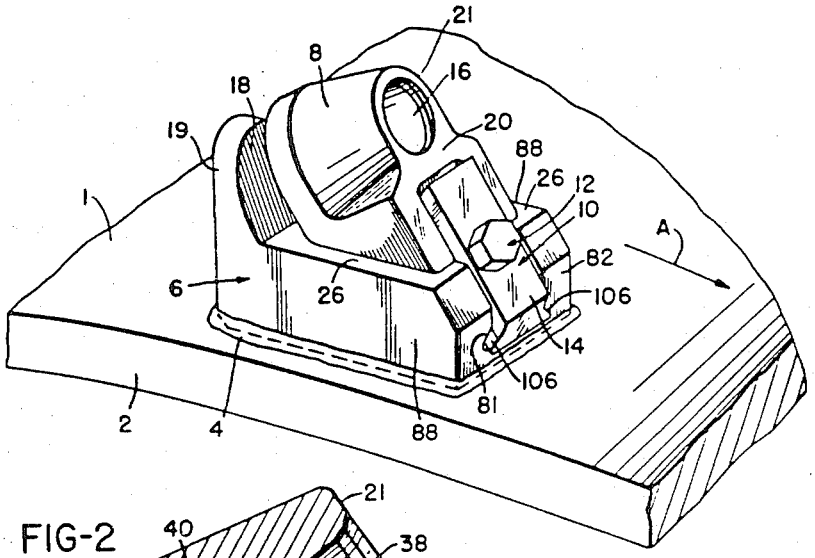
FIG. 1 is a perspective view of an assembled clevis, support block and locking mechanism welded onto a rotary drum according to the present invention indicating the forward direction.
Figure 2:
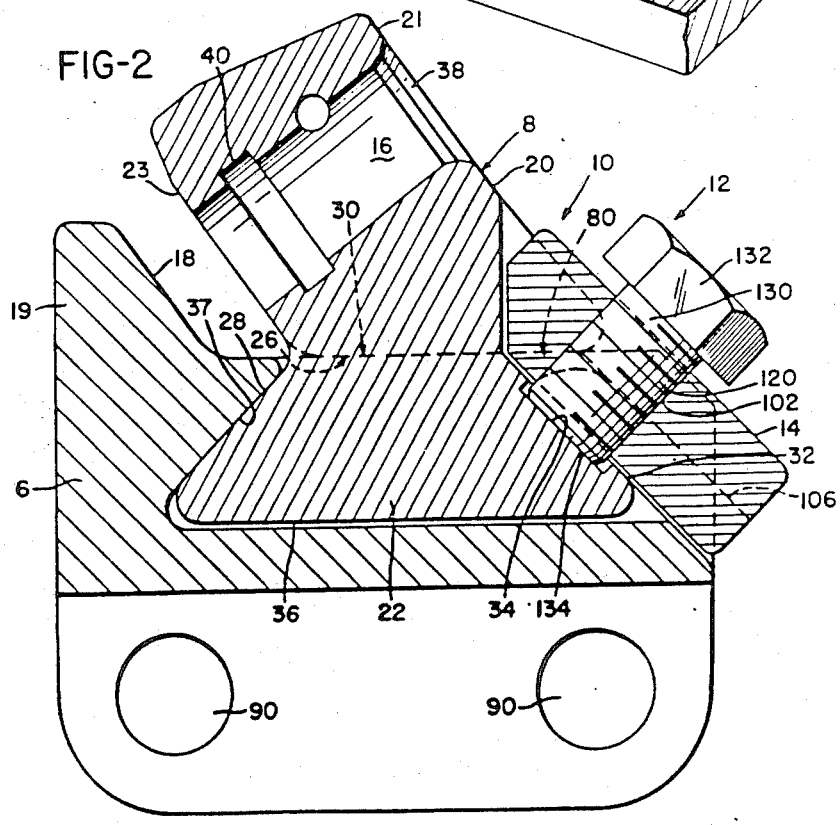
FIG. 2 is a sectionalized view of the invented arrangement shown in FIG. 1.

Referring to the figures somewhat more in detail, shown in FIGS. 1 and 2 are a cutter bit support block 8 mounted in a clevis 6. The support block 8 is locked into the clevis 6 by a locking mechanism 10. The support block 8 is made up of two main components, an upper portion 20 and a lower portion 22. The upper portion 20 has a perforation 16 passing through it. Perforation 16 is designed to hold the shank 46 of a cutter bit 44. The lower portion of the support block has a forward face 32 which slants upward and rearward and a rear face 28 which slants upward and forward. Arrow A indicates the forward direction, the direction in which this device is designed to be driven.

On either side of the upper body portion 20 of the support block 8 are downward facing longitudinal shoulders 30 ending at the juncture of the upper 20 and lower 22 body portions and which abut with upward facing abutment shoulders 26 located at the top of longitudinal walls 88 of clevis 6.

The locking mechanism 10 is made up of two main components, a rectangular-like prism body 14 which has a perforation 102 communicating between its top and bottom faces. Perforation 102 is circular in cross section and has threads 120 on it. Located in perforation 102 is a means 12 for releasable locking and abutment with a support block 8 and releasable locking with a clevis 6.

As shown in FIG. 2, said means 12 for releasable locking and abutment is a bolt 12 having a threaded portion 130 and a means for rotating 132 located on one end of the bolt 12. On the other end of the bolt 12 is a support block abutment surface 134 which is shown abutting against a recessed wall 34 on a rearwardly and upwardly sloping forward face 32 of support block lower body portion 22. Said abutment between the locking bolt 12 and the support block lower body portion 22 drives the rear, slanting forwardly upward face 28 of the lower body portion 22 into abutment with a similarly slanting rear wall 37 in the clevis 6. In this manner, the support block is pulled down into the clevis channel 84 such that the longitudinal downward facing abutment shoulders 30 on support block 8 are in abutment with the upward facing abutment shoulders 26 on the clevis 6. The support block 8, lower body portion 22 is a polyhedron approximating the outline of a truncated right triangular prism whose largest base forms the bottom face 36 of said lower body portion. The forward 32 and rear 28 faces of the lower body portion 22 can be inclined at 25 to 75 degrees to the horizontal and need not be both inclined at the same angle.

The perforation 16 passing through the upper body portion 20 of the support block 8 communicates between a forward face 21 and a rearward face 23 of the upper body portion 20. Said perforation has means for supporting 38 and retaining 40 a shank of a cutter bit. Shown in FIG. 2 are cutter bit abutment shoulders 38 and a recess 40 for holding a retainer clip.

It will additionally be noted that the locking mechanism is slidably engaged in the grooves 80 in the clevis longitudinal walls 88. When the bolt 12 is in abutting engagement with the lower body portion 22 of the support block 8, the wing-like projection 106 on the locking mechanism 10 are also in abutting engagement with face 81 of groove 80.

The arrangement shown in FIG. 1 has been joined by a weldment 4 to the peripheral surface 1 of a rotary drum 2. It should also be noted that the clevis can additionally be joined by bolting or pinning arrangement to a rotary drum or continuous chain.

Shown in FIG. 2 are means for joining the clevis to links in a continuous chain. The embodiment shown in FIG. 2 consists of transverse perforations 90 passing through the clevis. These perforations 90 may be located either below the clevis channel or in front of and behind the clevis channel, as needed.

Figure 3:
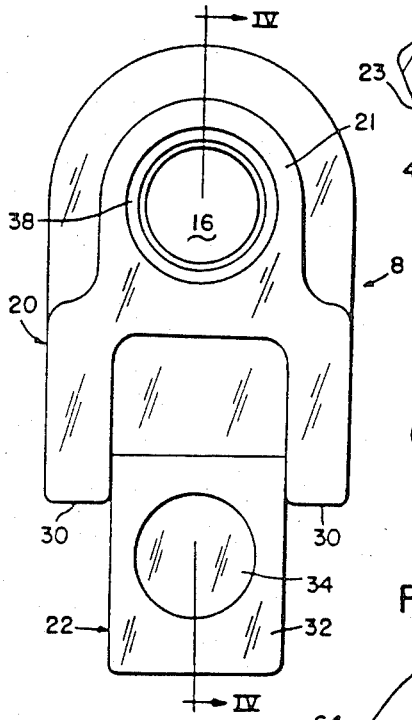
FIG. 3 is a front view of invented support block as shown in FIGS. 1 and 2.

Referring to FIG. 3, a forward view of the support block is shown. The forward face 32 of the lower body portion 22 is shown with a recess 34 located centrally. On the upper body portion 20, the perforation 16 for retaining a cutter bit shank is also shown.

Figure 4:
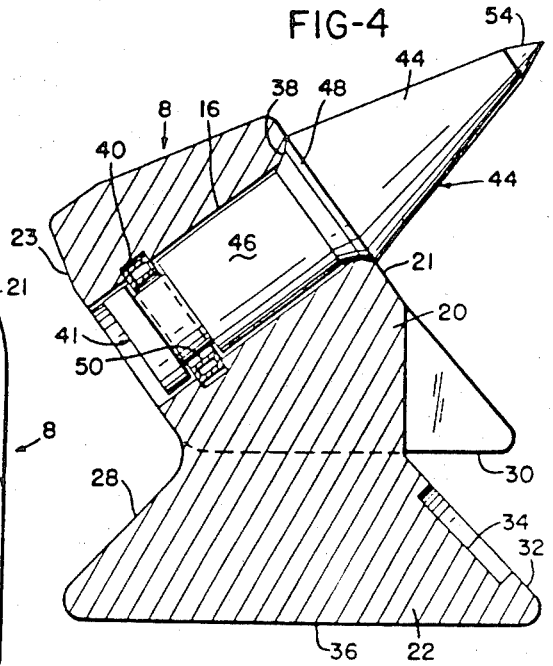
FIG. 4 is a sectionalized view of the support block shown in FIG. 3 along line IV—IV with a rotatable conical cutter bit.

In FIG. 4, a support block 8 is shown with a cutter bit 44 mounted within it. A cutter bit 44, which is a point-attack cutter bit with a conical point 54, is in abutting engagement with shoulders 38 of the support block. The shank 46 of the cutter bit is retained in the support block by a clip retaining means 50 which is located in a recess 40 in the perforation 16. Abutment shoulders 48 on cutter bit 44 are in abutment with abutment shoulders 38 on the support block 8.

Figure 5:
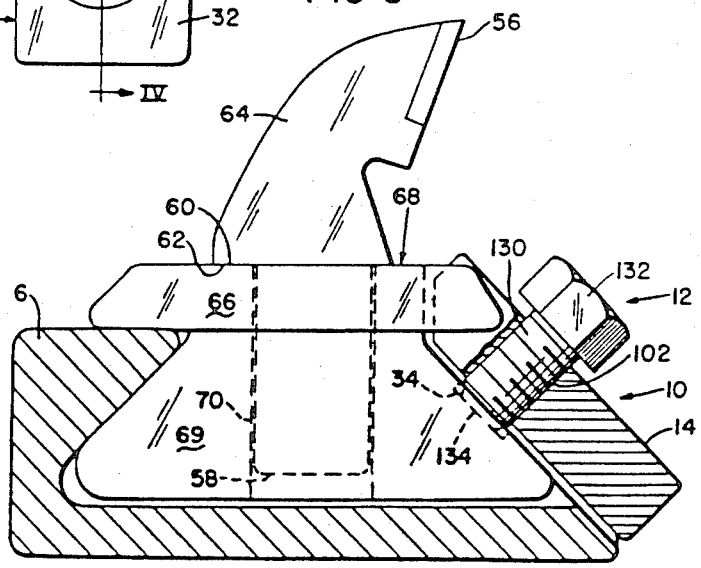
FIG. 5 is a sectionalized view of an arrangement as shown in FIGS. 1 and 2, but with an alternate embodiment of the support block, which is shown holding a nonrotatable flat face cutter bit.

In FIG. 5, an alternate embodiment of a cutter bit support block 68, clevis 6, and locking mechanism 10 is shown. A nonrotatable cutter bit 64 having a flat attack face 56 is shown mounted in a support block 68 having an upper portion 66 and a lower body portion 69. Additionally, there is a perforation 70 passing vertically through the support block and in which the shank 58 of the cutter bit 64 is located. The shank 58 is rectangular. Shoulders 60 of the cutter bit are in engagement with shoulders 62 on the support block.

Figure 6:
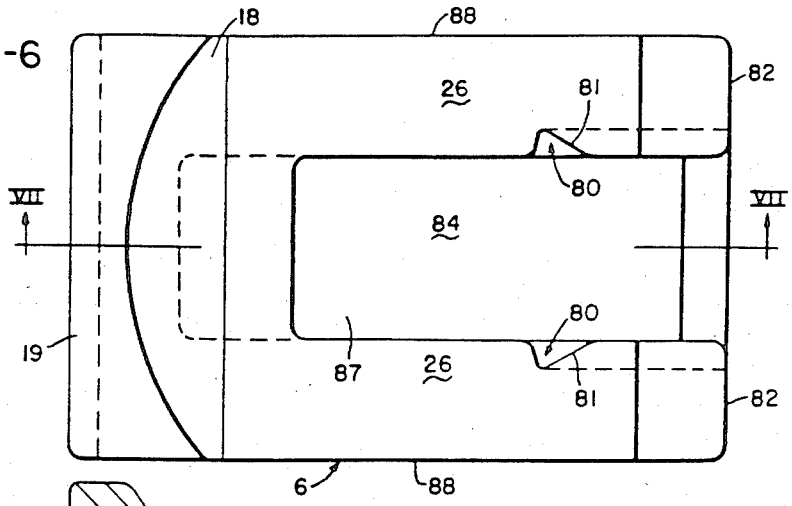
FIG. 6 is a top view of an embodiment of the clevis according to the present invention.
Figure 7:
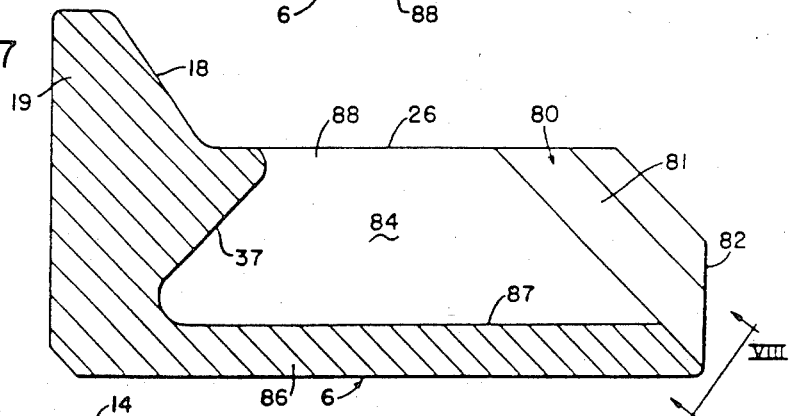
FIG. 7 is a sectionalized side view of the clevis in FIG. 6 viewed along line VII—VII.
Figure 8:
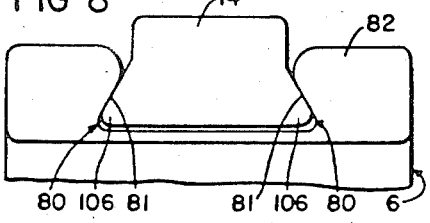
FIG. 8 is a partial view of the clevis in FIG. 7 viewed along arrow VIII showing the cross section of an embodiment of the locking mechanism holding means showing the body of a locking mechanism engaged in it.

Shown in FIGS. 6, 7 and 8 is a more detailed layout of the clevis. The clevis 6 is made up of longitudinal walls 88 having upward facing abutment shoulders 26 and a forward facing end 82. Located between longitudinal walls 88 is a channel 84. The longitudinal walls 88 are joined by a forwardly and upwardly slanting block abutment wall 37 which forms the rear wall on the channel. This block abutment wall 37 forms an interacting and cooperating means for abutment with the locking mechanism 10 for holding the support block 8 in the clevis 6.

Located above and behind the channel is a bit seating body 19 having a forward facing rearwardly sloping surface 18 for abutment with the butt end 41 of an attack bit 44. This bit seating body can alternatively be part of the support block if so desired or left out completely as the situation requires.

Located near the forward end 82 of each wall 88 is a means for retaining the locking mechanism 10. As shown in these figures, this means consists of a groove 80 communicating obliquely between the upward facing abutment shoulders 26 and the bottom of the channel 87 at the forward end 82 of the clevis 6. The channel may be closed at the bottom by a wall 86, but this is not necessary.

When the locking mechanism body 14 is engaged in the groove 80 and the bolt 12 is in abutment with the support block 8, wing-like projections 106 will be in abutment with groove faces 81 thereby locking the locking mechanism in place in the clevis 6.

Figure 9:
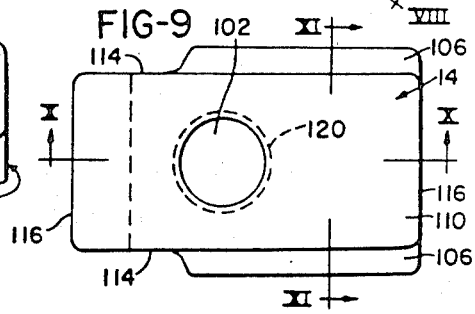
FIG. 9 is a front view of an embodiment of the locking mechanism according to the present invention, but without the locking bolt.
Figure 10:
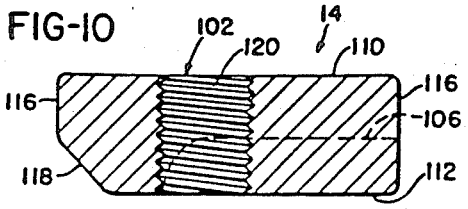
FIG. 10 is a sectionalized side view of the embodiment shown in FIG. 9 viewed along line X—X.
Figure 11:
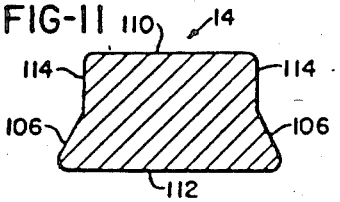
FIG. 11 is a sectionalized end view of the embodiment shown in FIG. 9 viewed along line XI—XI.

FIGS. 9, 10 and 11 show a detailed layout of the locking mechanism body 14. In the embodiment shown, the body 14 consists of a rectangular-like prism shape having opposite major faces, one being the top 110 and the other the bottom 112, longitudinal faces 114 and end faces 116. A perforation 102 communicates between the top 110 and bottom 112 faces. This perforation 102 has a circular cross section and has threads 120. Located on the longitudinal faces 114 are means for slidable engagement, shown herein as wing-like projections 106. Additionally, located on one of the end faces 116 joining the end face to the bottom face 112 and to longitudinal faces 114 is a chamfer 118.

Referring back to FIG. 2, the other portion of the support block locking mechanism, the means for releasable locking and abutment with a support block and releasable locking with a clevis, is shown. This portion is the bolt 12. The bolt is comprised of a threaded portion 130, a means for rotating the bolt 132 located at one end, and a support block abutment surface 134 at the other end of the bolt. Additionally, means for preventing rotation of the bolt due to vibration may also be mounted on the bolt, this means for preventing rotation may consist of a lock washer, a jam nut or a plastic plug.

FIGS. 12 and 13 show an alternate embodiment of the support block and clevis systems shown in the previous drawings. FIG. 12 shows a support block held in the channel of a clevis 202 by a lock bolt 204 located at the rear of the clevis behind the support block 200. The support block 200 has an upper body portion 206 and a lower body portion 208. The lower body portion 208 has a forward face 210 slanting rearwardly upward and a rear face 212 slanting forwardly upward. As can be seen in FIGS. 12 and 13, the upper body portion 206 has downwardly facing longitudinal shoulders 214 extending along its sides and ending at the juncture of said upper and lower body portions of the support block 200.

The support block 200 is also shown having a perforation 216 for receiving a mining or construction bit and may also have a bit seating structure 218 rising up from the lower body portion 208 and behind the upper body portion 206. As shown in FIG. 12, a notch is formed in the rear of the lower body portion 208 for receiving the locking bolt 204.

As is most clearly seen in FIG. 13, the lower body portion 208 is narrower than the upper body portion 206, and is preferably sized to slidingly fit within the width of the clevis channel 222.

The clevis as shown in FIGS. 12 and 13 has two longitudinal walls 224 having upward facing abutment shoulders 226 or abutment with the downward facing shoulders 214 on the attack bit support block. The channel 222 located between the longitudinal walls 224 is open at its top for receiving the lower body portion 208 of the support block and closed at its forward and rear ends by transverse walls 228 and 230, respectively. Forward wall 228 communicates between the two longitudinal walls 224 and slopes upwardly and rearwardly at an angle so as to abut the rearwardly and upwardly sloping forward face 210 of the lower portion of the support block. The rear transverse wall 230 has a threaded aperture communicating between it and the rear of the clevis. Preferably, this aperture slopes forwardly as it slopes downwardly such that its axis is approximately perpendicular to the rear sloping surface 212 on the support block 200.

A locking bolt 204 is threadedly engaged in the clevis aperture such that advancing the bolt through the aperture will cause the end of the bolt to abut rear surface 212 on the support block. In this manner, the support block 200 is driven downwardly and forwardly in the clevis channel 222 so that downward facing shoulders 214 are in pressurized abutment with upward facing shoulders 226, and sloping surface 210 on the lower body portion 208 is in abutment with transverse wall 228.

In order to resist loosening due to vibration, the bolt 204 has been provided with a plastic plug 232.

While the embodiment shown in FIGS. 12 and 13 is not provided with a locking mechanism 10 separate from the clevis as shown in FIGS. 1 through 11, the bolt has been moved from the front to the rear of the clevis. The upper body portion of the support may now act as a shield to protect the bolt from damage.

Modifications may be made within the scope of the appended claims.

What is claimed is:

1. A cutter bit support block adapted to be driven in a forward direction comprising: a lower body portion having a forward face slanting rearwardly upward and a rear abutment face slanting forwardly upward, said lower body portion being a polyhedron approximating the outline of a truncated right triangular prism whose largest base forms the bottom face of said lower body portion; an upper body portion having downward facing longitudinal shoulders ending at the juncture of said upper and lower body portions; and a perforation for receiving the shank of a cutter bit, said perforation communicating between an upper body portion forward face and an upper body portion rearward face.

2. A cutter bit support block according to claim 1 wherein said lower body forward face and said lower body rearward face slant upward at substantially a 25 to 75 degree incline to the horizontal.

3. A cutter bit support block according to claim 1 wherein the downward face of said downward facing longitudinal shoulders are substantially horizontal.

4. A cutter bit support block according to claim 3 wherein said longitudinal shoulders extend forward past all other features of said upper body portion.

5. A cutter bit support block according to claim 4 wherein said perforation is inclined forwardly upward.

6. A cutter bit support block according to claim 1 wherein said perforation is further comprised of means for support and retention of a cutter bit shank.

7. A cutter bit support block according to claim 1 wherein said lower body portion is further comprised of a recess located in said forward face.

8. A clevis adapted to be driven in a forward direction for supporting a cutter bit support block adapted to be driven in a forward direction comprised of: two longitudinal walls having upward facing abutment shoulders for abutment with downward facing shoulders on an attack bit support block; a channel located between said longitudinal walls, said channel being open on the forward and top ends and closed at its rear by an upwardly and forwardly sloping block abutment wall joining the longitudinal walls of said channel; said forwardly and upwardly sloping block abutment wall angled so as to abut with a rear forwardly and upwardly sloping face on the lower portion of an attack bit support block; means for holding a support block locking mechanism, said means located near the forward end of said clevis.

9. A clevis according to claim 8 wherein the bottom of said channel is closed by a bottom wall joining said longitudinal walls and said block abutment wall and wherein said longitudinal walls are substantially vertical and the distance between said walls sufficient only to allow the entrance of the lower portion of a bit support block.

10. A clevis according to claim 8 further comprising means for joining said clevis to links and clevi so as to form a link in continuous chain, and wherein said means for joining are located to the rear of said bit seating surface and in front of each longitudinal wall.

11. A clevis according to claim 8 further comprising means for joining said clevis to similar clevi so as to form a link in a continuous chain, wherein said means for joining are located at a level below the lower extremity of said block abutment wall.

12. A clevis adapted to be driven in a forward direction for supporting a cutter bit support block adapted to be driven in a forward direction comprised of: two longitudinal walls having upward facing abutment shoulders for abutment with downward facing shoulders on an attack bit support block; a channel located between said longitudinal walls, said channel being open on the forward and top ends and closed at its rear by an upwardly and forwardly sloping block abutment wall joining the longitudinal walls of said channel; said forwardly and upwardly sloping block abutment wall angled so as to abut with a rear forwardly and upwardly sloping face on the lower portion of an attack bit support block; means for holding a support block locking mechanism, said means located near the forward end of said clevis, wherein said means for holding a support block locking mechanism is comprised of an open ended groove in each of said longitudinal walls of said channel communicating obliquely upward and rearwardly between the bottom of the forward open end of said channel to the upward facing abutment shoulder of said longitudinal wall.

13. A clevis according to claim 12 wherein said open ended groove in each of said longitudinal walls is inclined at 25 to 70 degrees to the horizontal.

14. A clevis adapted to be driven in a forward direction for supporting a cutter bit support block adapted to be driven in a forward direction comprising: two longitudinal walls having upward facing abutment shoulders for abutment with downward facing shoulders on an attack bit support block; a channel located between said longitudinal walls, said channel being open on the forward and top ends and closed at its rear by an upwardly and forwardly sloping block abutment wall joining the longitudinal walls of said channel; said forwardly and upwardly sloping block abutment wall angled so as to abut with a rear forwardly and upwardly sloping face on the lower portion of an attack bit support block; means for holding a support block locking mechanism, said means located near the forward end of said clevis; and a bit seating body located behind said channel, joining said longitudinal walls and rising above said upward facing abutment shoulders, said bit seating body having a forward facing, rearwardly sloping surface to support the butt end of a cutter bit shank held by a support block.

15. A clevis adapted to be driven in a forward direction for supporting a cutter bit support block adapted to be driven in a forward direction comprised of: two longitudinal walls having upward facing abutment shoulders for abutment with downward facing shoulders on an attack bit support block; a channel located between said longitudinal walls wherein the bottom of said channel is open, said channel being open on the forward and top ends and closed at its rear by an upwardly and forwardly sloping block abutment wall joining the longitudinal walls of said channel; said forwardly and upwardly sloping block abutment wall angled so as to abut with a rear forwardly and upwardly sloping face on the lower portion of an attack bit support block; means for holding a support block locking mechanism, said means located near the forward end of said clevis.

16. A clevis according to claim 15 wherein said longitudinal walls are substantially vertical and the distance between said walls sufficient only to allow the entrance of the lower portion of a bit support block.

17. A rotary drum having mounted around its peripheral surface clevi for supporting cutter bit support blocks wherein said clevi are comprised of: two longitudinal walls having upward facing abutment shoulders for abutment with downward facing shoulders on a cutter bit support block; a channel located between said longitudinal walls, said channel being open on the forward and top ends and closed at its rear by an upwardly and forwardly sloping block abutment wall joining the longitudinal walls of said channel; said forwardly and upwardly sloping block abutment wall angled so as to abut with a rear forwardly and upwardly sloping face on the lower portion of an attack bit support block; means for holding a support block locking mechanism, said means located near the forward end of said clevis.

18. A rotary drum having mounted around its peripheral surface clevi for supporting cutter bit support blocks wherein said clevi are comprised of: two longitudinal walls having upward facing abutment shoulders for abutment with downward facing shoulders on a cutter bit support block; a channel located between said longitudinal walls, said channel being open on the forward and top ends and closed at its rear by an upwardly and forwardly sloping block abutment wall joining the longitudinal walls of said channel; said forwardly and upwardly sloping block abutment wall angled so as to abut with a rear forwardly and upwardly sloping face on the lower portion of an attack bit support block; means for holding a support block locking mechanism, said means located near the forward end of said clevis, wherein said means for holding a support block locking mechanism is comprised of an open ended groove in each of said longitudinal walls of said channel communicating obliquely upward and rearwardly between the bottom of the forward open end of said channel to the upward facing abutment shoulder of said longitudinal wall.

19. A continuous chain having links comprised of a clevis for supporting a cutter bit support block, wherein said clevis is comprised of: two longitudinal walls having upward facing abutment shoulders for abutment with downward facing shoulders on a cutter bit support block; a channel located between said longitudinal walls, said channel being open on the forward and top ends and closed at its rear by an upwardly and forwardly sloping block abutment wall joining the longitudinal walls of said channel; said forward upwardly sloping block abutment wall angled so as to abut with a rear forwardly and upwardly sloping face on the lower portion of a cutter bit support block; means for holding a support block locking mechanism, said means located near the forward end of said clevis.

20. A continuous chain having link comprised of a clevis for supporting a cutter bit support block, wherein said clevis is comprised of: two longitudinal walls having upward facing abutment shoulders for abutment with downward facing shoulders on a cutter bit support block; a channel located between said longitudinal walls, said channel being open on the forward and top ends and closed at its rear by an upwardly and forwardly sloping block abutment wall joining the longitudinal walls of said channel; said forward upwardly sloping block abutment wall angled so as to abut with a rear forwardly and upwardly sloping face on the lower portion of a cutter bit support block; means for holding a support block locking mechanism, said means located near the forward end of said clevis, wherein said means for holding a support block locking mechanism is comprised of an open ended groove in each of said longitudinal walls of said channel communicating obliquely upward and rearwardly between the bottom of the forward open end of said channel to the upward facing abutment shoulder of said longitudinal wall.

21. A support block locking mechanism for firmly and rigidly securing a cutter bit support block to a clevis comprising: a body having a perforation, wherein said body is comprised of a rectangular-like prism shape having two opposite major faces forming the top and bottom faces, two longitudinal faces, and two end faces, and said perforation communicating between said top and bottom faces; means for causing releasable abutment with said support block and said clevis while urging said body away from said support block; said means engaged in said perforation; and means for slidable engagement with a grooved holding means in said clevis, said means for slidable engagement located on each longitudinal face of said body.

22. A support block locking mechanism according to claim 21 wherein said means for slidable engagement are comprised of wing-like projections.

23. A support block locking mechanism according to claim 21 further comprised of a chamfer joining one of said end faces with said bottom face and joining said longitudinal faces.

24. A support block locking mechanism according to claims 21 wherein said perforation is further comprised of a threaded circuit cross section, and said means for releasable abutment with said support block and said clevis, held in said perforation comprises a threaded bolt, the threads of said bolt engaged with the threads of said perforation.

25. A support block locking mechanism according to claim 24 wherein said bolt is further comprised of means for rotating said bolt located at one end of said bolt, a support block abutment surface located at the end opposite said one end of the bolt, and means for preventing rotation of said bolt in said perforation due to vibration.

26. In combination; a cutter bit support block adapted to be driven in a forward direction and comprising a lower body portion having a forward face slanting rearwardly upward and a rear abutment face slanting forwardly upward, an upper body portion having downward facing longitudinal shoulders ending at the juncture of said upper and lower body portions, and a perforation for receiving the shank of a cutter bit, said cutter bit support block fixedly and rigidly held in a channel in a clevis by a support block locking mechanism wherein said combination comprises said support block locking mechanism and said clevis, each having interacting and cooperating means for abutment with, and application of a downward pressure to, said lower body portion of said support block; and pressurized abutment of said downward facing longitudinal shoulders of said support block with upward facing abutment shoulders of two longitudinal walls forming said channel of said clevis due to said interacting and cooperating means of said support block locking mechanism and said clevis.

27. In combination; a cutter bit support block adapted to be driven in a forward direction and comprising a lower body portion having a forward face slanting rearwardly upward and a rear abutment face slanting forwardly upward, an upper body portion having downward facing longitudinal shoulders ending at the juncture of said upper and lower body portions, and a perforation for receiving the shank of a cutter bit, said cutter bit support block fixedly and rigidly held in a channel in a clevis by a support block locking mechanism wherein said combination comprises said support block locking mechanism slidably engaged in recesses for holding in the forward end of said clevis; said support block locking mechanism having a perforation, holding means for releasable abutment with a support block and releasable locking of means for slidable engagement in said clevis holding means; said means for releasable abutment applying rearward and downward pressure to said forward face of said support block while simultaneously applying through said means for slidable engagement located in said clevis holding means a forward and upward pressure against said clevis releasably fixing said support locking mechanism in relation to said clevis and said support block held in said clevis; the rearward component of said rearward and downward pressure applied by said block locking mechanism to said support block causing said rear abutment face of said support block to abut with a rear forwardly and upwardly similarly sloping block abutment wall forming the rear wall of a channel in said clevis located between two longitudinal walls having upward facing abutment shoulders which rigidly abut and support said downward facing abutment shoulders on said support block due to said rearward and downward pressure applied by said support block locking mechanism to said support block.

28. The combination according to claim 27 further comprising a cutter bit having its shank held in said means for holding a cutter bit in said support block.

29. A cutter bit support block adapted to be driven in a forward direction comprising a lower body portion having a forward face slanting rearwardly upward and a rear abutment face slanting forwardly upward; an upper body portion having downward facing longitudinal shoulders ending at the juncture of said upper and lower body portions; said shoulders extending forwardly along the lateral sides of said support block; a perforation for receiving the shank of a cutter bit; and a bit seating portion located rearwardly of said upper body portion.

30. A clevis adapted to be driven in a forward direction, comprising: two longitudinal walls having upward facing abutment shoulders for abutment with downward facing shoulders on an attack bit support block; a channel located between said longitudinal walls; said channel being open at its top end and closed at its rear and forward ends by transverse walls joining said longitudinal walls; said transverse wall at the forward end of said channel sloping upwardly and rearwardly at an angle so as to abut with a rearwardly and upwardly sloping forward face on the lower portion of an attack bit support block; means for holding said support block in abutment with said upwardly facing abutment shoulders and said forward transverse wall.

31. A clevis adapted to be driven in a forward direction, comprising: two longitudinal walls having upward facing abutment shoulders for abutment with downward facing shoulders on an attack bit support block; a channel located between said longitudinal walls; said channel being open at its top end and closed at its rear and forward ends by transverse walls joining said longitudinal walls; said transverse wall at the forward end of said channel sloping upwardly and rearwardly at an angle so as to abut with a rearwardly and upwardly sloping forward face on the lower portion of an attack bit support block; means for holding said support block in abutment with said upwardly facing abutment shoulders and said forward transverse wall, wherein said means for holding comprises a bolt threadedly engaged in a perforation in said clevis communicating with said rear transverse wall.

32. A clevis according to claim 31 wherein said bolt extends through said rear transverse wall in a forwardly and downwardly direction.

33. In combination: a cutter bit support block adapted to be driven in a forward direction and comprising a lower body portion having a forward face slanting rearwardly upward and a rear abutment face slanting forwardly upward, an upper body portion having downward facing longitudinal shoulders ending at the juncture of said upper and lower body portions, said shoulders extending forwardly along the lateral sides of said support block, and a perforation for receiving the shank of a cutter bit, said cutter bit support block fixedly and rigidly held in a channel in a clevis, wherein said combination comprises: said clevis having two longitudinal walls separated by said channel; said longitudinal walls having upward facing abutment shoulders for abutment with said downward facing shoulders on said support block; transverse walls joining said longitudinal walls at the forward and rear ends of said channel; said transverse wall at the forward end of said channel sloping upwardly and rearwardly; means for forcing said support block downwardly and forwardly in said channel; and said means for forcing holding said downward facing shoulders on said support block in pressurized abutment with said upward facing abutment shoulders, and holding said rearwardly and upwardly sloping forward face on said support block in pressurized abutment with said forward end transverse wall.

34. A cutter bit support block adapted to be driven in a forward direction comprising: a lower body portion having a forward face slanting rearwardly upward and a rear face slanting forwardly upward; an upper body portion having downward facing longitudinal shoulders ending at the juncture of said upper and lower body portions; a perforation for receiving the shank of a cutter bit; and wherein said longitudinal shoulders extend forward past all other features of said upper body portion.

35. A cutter bit support block adapted to be driven in a forward direction comprising: a lower body portion having a forward face slanting rearwardly upward and a rear face slanting forwardly upward; an upper body portion having downward facing longitudinal shoulders ending at the juncture of said upper and lower body portions; a perforation for receiving the shank of a cutter bit; a recess located in the forward face of said lower body portion.

36. A clevis adapted to be driven in a forward direction for supporting a cutter bit support block adapted to be driven in a forward direction comprised of: two longitudinal walls having upward facing abutment shoulders for abutment with downward facing shoulders on an attack bit support block; a channel located between said longitudinal walls, said channel being open on the forward and top ends and closed at its rear by an upwardly and forwardly sloping block abutment wall joining the longitudinal walls of said channel; said forwardly and upwardly sloping block abutment wall angled so as to abut with a rear forwardly and upwardly sloping face on the lower portion of an attack bit support block; means for holding a support block locking mechanism; said means comprised of a groove in each of said longitudinal walls of said channel; said means located near the forward end of said clevis.

37. In combination; a cutter bit support block adapted to be driven in a forward direction and comprising a lower body portion having a forward face slanting rearwardly upward and a rear abutment face slanting forwardly upward, an upper body portion having downward facing longitudinal shoulders ending at the juncture of said upper and lower body portions, and a perforation for receiving the shank of a cutter bit, said cutter bit support block fixedly and rigidly held in a clevis by a support block locking mechanism, wherein, said combination comprises a clevis having two longitudinal walls having upwardly facing abutment shoulders abutted against said downwardly facing longitudinal shoulders of said support block; said clevis having a channel located between said longitudinal walls, said channel being open on the forward and top ends and closed at its rear by an upwardly and forwardly sloping block abutment wall which joins the longitudinal walls of said channel; the width of said channel being only as wide as needed to accept said lower body portion of said support block located in said channel of said clevis wherein said lower body rearward face is firmly mated and abutted against said block abutment wall of said clevis; said block abutment wall and said rearward face having approximately the same angle of inclination; each of said longitudinal walls of said channel has an open ended groove just forward of and substantially parallel to said forward face of said lower body portion of said support block; rigidly but releasably located in said open ended grooves are the wings of a dovetail mechanism having a bolt threadedly engaged through a perforation in said mechanism wherein said bolt is torqued down so that it is rigidly but releasably abutted against said recess in said forward face of said lower body portion of said support block in a manner that applies rearward and downward pressure to the support block and forces the wings of the dovetail mechanism into rigid but releasable abutment with the faces of said grooves in said channel walls facing said support block; means for preventing rotation of said bolt in said perforation due to vibration.

38. In combination; a cutter bit support block adaped to be driven in a forward direction and a cutter bit, said cutter bit support block comprising a lower body portion having a forward face slanting rearwardly upward and a rear abutment face slanting forwardly upward, an upper body portion having downward facing longitudinal shoulders ending at the juncture of said upper and lower body portions, and a perforation for receiving the shank of a cutter bit, wherein the combination comprising means for holding said cutter bit in said support block holding the shank of said cutter bit.

39. A cutter bit support block adapted to be driven in a forward direction comprising a lower body portion having a forward face slanting rearwardly upward and a rear abutment face slanting forwardly upward; a recess, wherein said rear abutment face slanting forwardly upward forms a part of said recess; an upper body portion having downward facing longitudinal shoulders ending at the juncture of said upper and lower body portions; said shoulders extending forwardly along the lateral sides of said support block; a perforation for receiving the shank of a cutter bit; and a bit seating portion located rearwardly of said upper body portion.

40. In combination; a cutter bit support block adapted to be driven in a forward direction and comprising a lower body portion having a forward face slanting rearwardly upward and a rear abutment face slanting forwardly upward, a recess, wherein said rear abutment face slanting forwardly upward forms a part of said recess, an upper body portion having downward facing longitudinal shoulders ending at the juncture of said upper and lower body portions, said shoulders extending forwardly along the lateral sides of said support block, and a perforation for receiving the shank of a cutter bit, said cutter bit support block fixedly and rigidly held in a channel in a clevis, wherein said combination comprises: said clevis having two longitudinal walls separated by said channel; said longitudinal walls having upward facing abutment shoulders for abutment with said downward facing shoulders on said support block; transverse walls joining said longitudinal walls at the forward and rear ends of said channel; said transverse wall at the forward end of said channel sloping upwardly and rearwardly; means for forcing said support block downwardly and forwardly in said channel; and said means for forcing holding said downward facing shoulders on said support block in pressurized abutment with said upward facing abutment shoulders, and holding said rearwardly and upwardly sloping forward face on said support block in pressurized abutment with said forward end transverse wall.

41. A cutter bit holder assembly including a clevis mountable on a driven working element of a mining machine or the like, a cutter bit support block releasably mounted on said clevis and a locking mechanism releasably locking said support block in said clevis, wherein the improvement comprises:

(a) said clevis including two spaced apart longitudinal side walls and a rear end wall joining said side walls at the rearward ends thereof so as to define a channel therebetween being open at its top and forward ends, said side walls having upwardly facing abutment shoulders at the tops thereof and rearwardly facing abutment shoulders at forward ends thereof, said rear end wall having an upwardly and forwardly sloping abutment surface;

(b) said cutter bit support block including an upper body portion and a lower body portion, said upper body portion having corresponding downwardly facing longitudinal shoulders for abutment with said upwardly facing shoulders of said clevis side walls, said lower body portion being slidable in said clevis channel and having a rear face that slants forwardly and upwardly for abutment with said abutment surface of said clevis rear end wall at the rear end of said channel, said lower body portion also having a front face; and (c) said locking mechanism including a body with projections formed on each side thereof which engage said rerwardly facing abutment shoulders on said forward ends of said clevis side walls and a fastener threadably engaged through said body such that its lower end abuts said forward face of said support block as said projections on said body engage said rearwardly facing abutment shoulders on said forward ends of said clevis side walls so as to force said downward facing abutment shoulders on said support block into abutment with said upward facing abutment shoulders on said clevis side walls and said rear face of said lower body portion of said support block into abutment with said abutment surface of said clevis rear end wall so as to releasably fix said support block in relation to said clevis and to apply a preload force via said support block against said clevis which resist movement of said support block relative to said clevis due to forces typically encountered during a cutting operation.

42. The cutter bit holder assembly according to claim 41, wherein:

said projections on said sides of said locking mechanism body are wing-like projections; and said rearwardly facing abutment shoulders on said forward ends of said clevis side walls are open ended grooves which slidably receive and are engaged by said wing-like projections.

43. The cutter bit holder assembly according to claim 41, wherein said open ended grooves at the forward ends of said clevis side walls communicate obliquely upward and rearwardly between a bottom of said forward open end of said clevis channel and said upward facing abutment shoulders of said clevis side walls.

44. The cutter bit holder assembly according to claim 43, wherein said open ended grooves at the forward ends of said clevis side walls are inclined at 25 to 70 degrees to the horizontal.

45. The cutter bit holder assembly according to claim 41, wherein said lower body portion of said support block has a recess located in said forward face thereof into which said lower end of said fastener extends in abutment therewith.

46. The cutter bit holder assembly according to claim 41, wherein:

said body of said locking mechanism has a threaded perforation defined therein; and said fastener of said locking mechanism is a threaded bolt threadably received in said perforation of said body.

47. The cutter bit holder assembly according to claim 46, wherein said bolt has a device associated therewith for preventing rotation of said bolt in said perforation of said body due to vibration.

48. The cutter bit holder assembly according to claim 41, wherein said upper body portion of said support block has a perforation therein for receiving a shank of a cutter bit.

* * * * *